US006520134B1

(12) United States Patent
Plunkett et al.

(10) Patent No.: US 6,520,134 B1
(45) Date of Patent: Feb. 18, 2003

(54) SCREEN PRINTABLE FOAM COATING FOR SEALING AND VIBRATION ISOLATION OF CAM COVER BAFFLES

(75) Inventors: Thomas P. Plunkett, Bolingbrook, IL (US); Thomas E. Staab, Chicago, IL (US); Kanu G. Shah, Arlington Heights, IL (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/976,084

(22) Filed: Oct. 11, 2001

(51) Int. Cl.[7] ..... F01M 9/10

(52) U.S. Cl. ..... 123/90.38; 123/90.37; 123/195 C; 123/198 E; 123/90.6; 181/207

(58) Field of Search ..... 123/90.38, 90.37, 123/41.86, 143 C, 90.6, 198 E; 181/200, 207, 208

(56) References Cited

U.S. PATENT DOCUMENTS 3,916,049 A * 10/1975 Kingsbury ..... 428/35
4,522,165 A * 6/1985 Ogawa ..... 123/195 C
4,730,556 A 3/1988 Cobbs, Jr. ..... 101/129
6,085,709 A * 7/2000 Freese, V ..... 123/90.38
6,113,109 A 9/2000 Lieb et al. ..... 277/590
6,180,167 B1 1/2001 Majewski et al. ..... 427/198
6,182,976 B1 2/2001 Maekawa et al. ..... 277/593

FOREIGN PATENT DOCUMENTS

JP 09203347 A * 8/1997 ..... F02F/7/00

* cited by examiner

*Primary Examiner*—Thomas Denion
*Assistant Examiner*—Ching Chang
(74) *Attorney, Agent, or Firm*—Rader, Fishman & Grauer PLLC

(57) ABSTRACT

A baffle for use in an interior of a cam cover and a method of making the baffle are disclosed. The baffle includes a structural layer, which is made of metal, and an isolation layer that is made of a resilient foam. The isolation layer is disposed on a surface of the structural layer in a pattern that leaves uncovered a portion of the surface of the structural layer. When the baffle is installed in the cam cover, the isolation layer provides an interface between the structural layer and the cam cover, which isolates the baffle from vibrations in the cam cover. Since the isolation layer is applied only where it is needed, the disclosed baffle and process use less material.

18 Claims, 2 Drawing Sheets

SCREEN PRINTABLE FOAM COATING FOR SEALING AND VIBRATION ISOLATION OF CAM COVER BAFFLES

BACKGROUND OF THE INVENTION

1. Field of Invention

This invention relates to baffles employed in cam covers of motor vehicle engines, and more particularly, to methods and materials for isolating the baffles from vibrations transmitted through the cam covers.

2. Discussion

Cam cover baffles used in motor vehicle engines aid in the removal of oil mist entrained in crankcase gases and are designed to optimize crankcase airflow through the cam (valve) cover. Conventional cam cover baffles are typically formed of a thin, single layer of stamped metal, such as steel. One problem with such baffle designs is that engine vibrations may cause the metal layer to resonate, resulting in undesirable noise generation. Designers have employed several techniques for resolving noise and vibration issues, including applying energy dissipating coatings on the metal layer.

Although baffle designs employing energy dissipating coatings have met with some success, the use of coatings creates other problems. For example, coatings add mass, and increase the material costs and labor associated with manufacturing the baffle. Additionally, it is often difficult to accurately control the thickness of the coating, which may result in sealing difficulties between the baffle and the cam cover and may lead to improper control of PCV emissions. Furthermore, portions of the coating may detach from the baffle during engine operation, which may contaminate the crankcase.

The present invention overcomes, or at least helps reduce the effects of one or more of the problems set forth above.

SUMMARY OF THE INVENTION

The present invention provides a baffle that is adapted for use in an interior of a cam cover, which addresses many of the problems described above. The baffle includes a base layer, which is made of metal, and an isolation layer that is comprised of a resilient foam. The isolation layer is disposed on a surface of the base layer in a pattern that leaves uncovered a portion of the surface of the base layer. When the baffle is installed in the cam cover, the isolation layer provides an interface between the base layer and the cam cover, thereby isolating the baffle from vibrations in the cam cover.

Another aspect of the invention provides a baffle that is adapted for use in an interior of a cam cover, which includes first and second structural layers, and a viscoelastic adhesive layer that is interposed between the two structural layers. The baffle also includes an isolation layer that is comprised of a resilient foam, which is disposed on a surface of the first structural layer in a pattern that leaves uncovered a portion of the surface of the first structural layer. The isolation layer provides an interface between the first structural layer and the cam cover when the baffle is installed in the interior of the cam cover.

Still another aspect of the invention provides a method of making a baffle for a cam cover. The method comprises providing a structural layer and applying an isolation layer on a surface of the structural layer in a pattern that leaves uncovered a portion of the surface of the structural layer. The isolation layer is comprised of a resilient foam, which dampens vibrations transmitted through the cam cover. In addition to providing improved vibration isolation, the inventive baffle and method use less materials and labor than conventional baffle manufacturing processes since the isolation layer is applied only where it is needed. Because the isolation layer does not completely cover the surface of the structural layer, and for the most part is sandwiched between the structural layer and the cam cover, there is less chance that the foamed material will detach from the baffle.

DETAILED DESCRIPTION OF THE PREFERRED EMBODIMENTS

Figure 1:
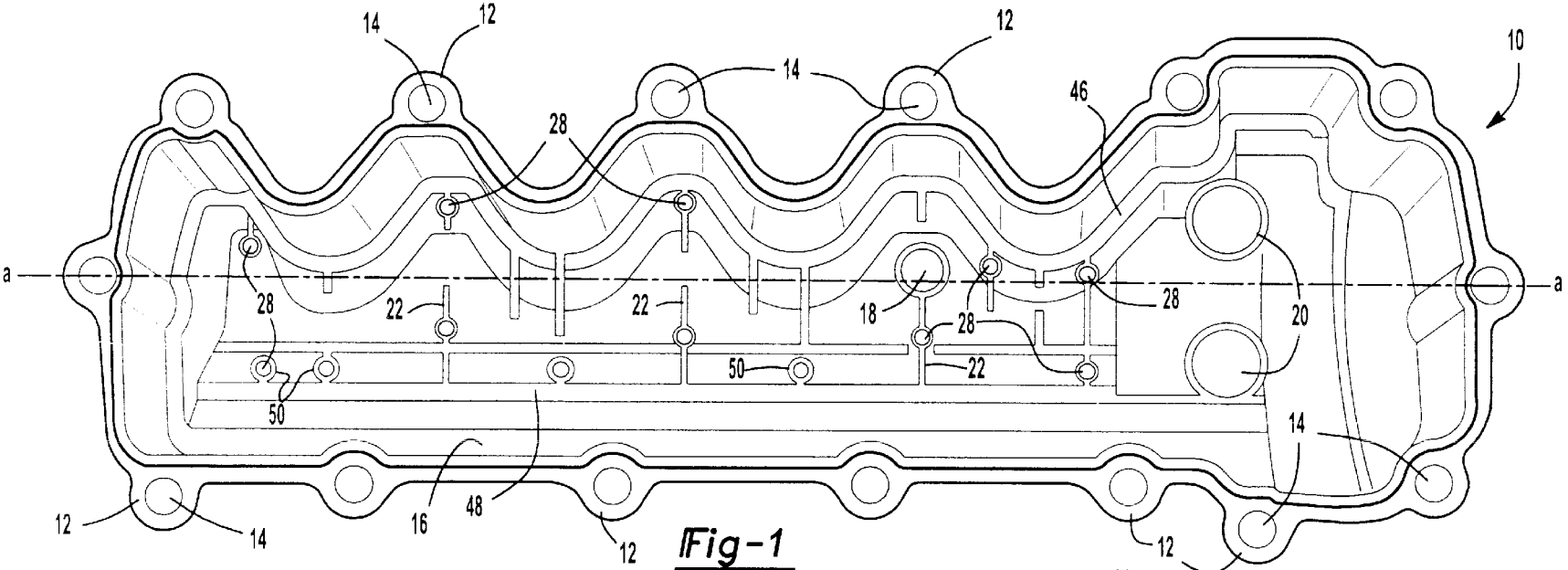
FIG. 1 is a plan view of an interior of a cam cover adapted to receive a baffle.

Referring to FIG. 1, a motor vehicle engine cam (valve) cover 10 is adapted to be securely attached to a cylinder head (not shown). Such cam covers have been traditionally made of stamped steel, but in recent years have also been made of molded plastic, cast aluminum, or cast magnesium materials. The cam cover 10 of FIG. 1 is formed of cast magnesium, and has a longitudinal dimension that extends along an axis a-a, as shown.

The cam cover 10 includes a plurality of bosses 12 for attachment of the cover 10 to the cylinder head of the engine. The bosses 12 include apertures 14, which permit passage of bolts that are used to secure the cam cover 10 to the cylinder head. The cam cover 10 comprises an interior 16 that includes a positive crankcase ventilation (PCV) aperture 18, which allows crankcase gases to vent through the cam cover 10 during engine operation.

The cover 10 incorporates other apertures 20, which may accommodate additional engine hardware, including cam phasers and similar electronic devices. The cam cover 10 also includes ribs 22 that extend laterally (i.e. transversely to the axis a-a) across sections of the interior 16 of the cam cover 10. In addition to providing structural support, and as discussed below, the ribs 22 create turbulence within a channel defined by a baffle 24 (FIG. 2) and the interior 16 of the cover 10.

Figure 2:
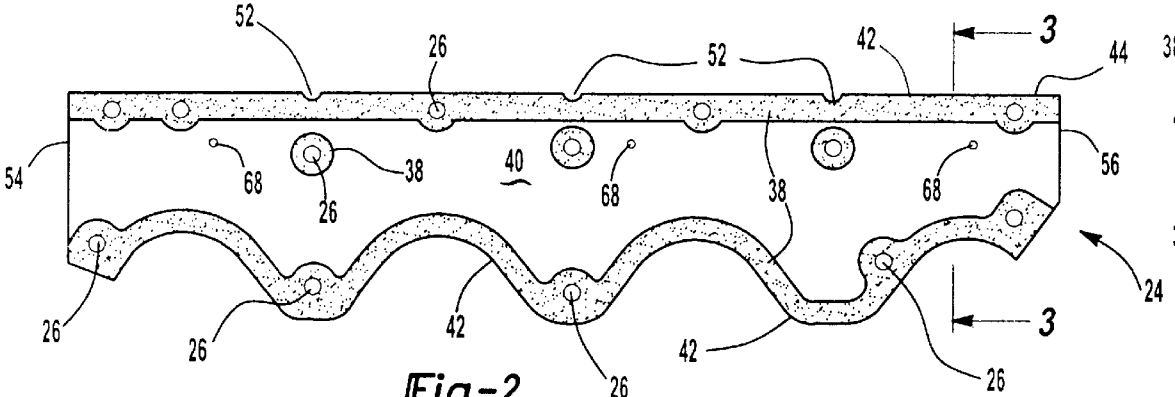
FIG. 2 is a plan view of one embodiment of a baffle for use in the cam cover of FIG. 1.

Referring to FIG. 1 and to FIG. 2, the baffle 24 includes a plurality of attachment apertures 26 that mate with a series of posts 28 when the baffle 24 is installed in the interior 16 of the cam cover 10. The posts 28, which are typically made of metal, are integrally affixed to the interior 16 of the cam cover 10, and are adapted to be heat staked—i.e., flattened against the baffle 24—in order to secure the baffle 24 to the cam cover 10. Other embodiments may use rivets, screws, etc. to attach the baffle 24 to the interior 16 of the cam cover 10.

Figure 3:
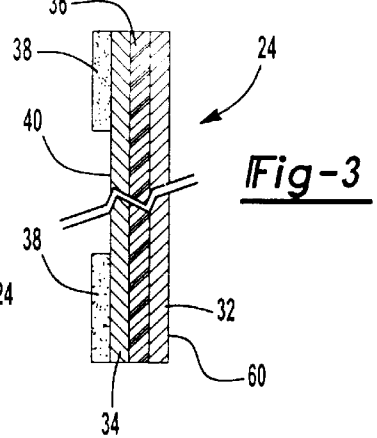
FIG. 3 is an enlarged cross-sectional side view of the baffle as viewed along section line 3—3 of FIG. 2.

As can be seen in FIG. 3, which is a cross-sectional view of the baffle 24 through reference line 3—3 of FIG. 2, the baffle 24 comprises four distinct layers. The baffle 24 includes a second structural layer 32 and a base structural layer 34 that are affixed to one another (i.e. constrained)

using a viscoelastic layer 36, which is interposed between the metal layers 32, 34. An isolation layer 38 is selectively applied to the base structural layer 34, and is advantageously made of a resilient foamed material as described below. Other embodiments may include baffles comprised of more or less than four layers, but would normally include at least the base structural layer 34 and the isolation layer 38.

Suitable materials for the structural layers 32, 34 include, without limitation, stamped metal plates, heat resistant plastics, and high temperature thermosetting polymers, etc. Particularly useful structural layers 32, 34 include those made of steel. The thickness of the structural layers 32, 34 is not critical, but typically lies within a range of about 0.2 mm to about 0.6 mm.

The viscoelastic adhesive layer 36 helps convert vibrational energy into heat, thereby dampening resonant vibrations that may generate noise. The viscoelastic layer 36 should be resistant to engine oil and should provide adequate adhesion between the structural layers 32, 34 at temperatures en countered in engines (e.g., up to about 150° C.). Useful viscoelastic adhesives may include, but are not limited to vulcanized or cross-linked elastomeric polymers. Such materials include natural rubber, isoprene rubber, butadiene rubber, styrene butadiene rubber, chloroprene rubber, butadiene acrylonitrile rubber, butyl rubber, ethylene propylene rubber (EPM, EPDM), acrylic rubber, halogenated butyl rubber, olefin-based rubber, urethane-based rubber (AU, EU), hydrin rubber (CO, ECO, GCO, EGCO), polysulfide-based rubber, silicone-based rubber, fluorine-based rubber (FKM, FZ), polyethylene chloride rubber, and blends of two or more of these elastomers.

The components or precursors of the viscoelastic adhesive layer 36 (e.g., base polymer and cross-linking agent) are blended together and then applied to the one or both of the structural layers 32, 34 using any conventional technique, such as roller coating, dipping, brushing, spraying, screen printing, and the like. Following application, the viscoelastic layer 36 is partially cured or B-staged so that it remains tacky. The two structural layers 32, 34 are then bonded together under heat and pressure (C-staged).

The precursors of the viscoelastic adhesive layer 36 may be cured or cross-linked using any known mechanism, including convection or radiation heating, or exposure to high-energy radiation, including electron beams or ultraviolet (UV) radiation. Useful UV curable adhesives typically comprise mixtures of multifunctional acrylate monomers and oligomers, photoinitiators, and surfactants. In addition to the base polymer or polymers and cross-linking agent, the viscoelastic adhesive layer 36 may include particulate fillers (e.g., carbon black, silica, etc.), antioxidants, plasticizers, curing co-agents, activators and catalysts, pot life extenders, and the like. The thickness of the viscoelastic adhesive layer 36 is not critical, but is usually about 0.15 mm or less.

Referring to FIG. 1 through FIG. 3, the isolation layer 38 does not completely cover the surface 40 of the base structural layer 34, but is disposed on the surface 40 in a pattern that leaves uncovered (exposed) a portion of the surface 40. In the embodiment shown in FIG. 2, the isolation layer 38 is present only on regions of the baffle 24 that will contact the cam cover 10. In other embodiments, the isolation layer 38 may cover more of the surface 40 of the base structural layer 34.

Selective application of the isolation layer 38 minimizes material costs and mass of the baffle 24, while providing an interface (i.e., vibration isolation) between the baffle 24 and the cam cover 10. For the baffle 24 shown in FIG. 2, the isolation layer 38 covers regions or strips located adjacent to first 42 and second 44 longitudinal edges of the baffle 24 and around the attachment apertures 26. When installed in the interior 16 of the cam cover 10, the isolation layer 38 adjacent to the first 42 and second 44 longitudinal edges of the baffle 24 contact and seal, respectively, undulating 46 and relatively straight 48 ridges that extend along axis a-a of the cam cover 10. Similarly, the isolation layer 38 located in regions around the attachment apertures 26 contacts and seals shoulders 50 circumscribing the posts 28.

As noted above, the isolation layer 38 comprises a resilient foamed material (e.g., closed cell material). Precursors or components of the foamed material include one or more cross-linkable polymers, a curing agent, and a blowing agent that generates gas when activated (e.g., heated). The isolation layer 38 may also include particulate fillers, antioxidants, plasticizers, curing co-agents, activators and catalysts, pot life extenders, and the like. The cross-linkable polymer may be one or more of the elastomeric materials used in the viscoelastic adhesive layer 36 described above. Like the viscoelastic adhesive layer 36, following cure the foamed material should be resistant to engine oil and should adhere to the requisite structural layer 34 at temperatures encountered in engines. Typically, the foamed material will exhibit at least about fifty percent compression at low stress levels (e.g., about 100 psi).

Particularly useful cross-linkable polymers include silicone rubber (e.g., polydimethylsiloxane), acrylonitrile butadiene rubber, and mixtures of acrylonitrile butadiene rubber and epoxy resin, which may be cross-linked using conventional curing agents. Any blowing agent may be used as long as it is compatible with the cross-linkable polymer. Suitable blowing agents include microspheres that expand upon heating and are available under the trade name EXPANCEL from EXPANCEL Inc. Other useful blowing agents include activated azodicarbonamide materials, which are available under the trade name CELOGEN from UNIROYAL CHEMICAL.

Prior to application, the isolation layer 38 precursors are blended together and applied to the surface 40 of the metal layer 34 using screen printing. Depending on the viscosity of the isolation layer 32 components, the screen mesh size may range from about 120 mesh to about forty mesh, though in many cases the mesh size may range from about sixty mesh to about forty mesh. Prior to foaming and curing, the isolation layer 38 may have a thickness ranging from about 0.2 mm to about 1 mm and between about 0.3 mm and about 1.5 mm when expanded (foamed). In many cases the foamed thickness may lie in a range from about 0.3 mm to about 0.5 mm.

Referring again to FIG. 1 and to FIG. 2, The baffle 24 includes a plurality of spaced-apart notches 52, which help locate the baffle 24 in the interior 16 of the cam cover 10. Each of the notches 52 is configured to mate with or clear one of the transverse ribs 22 located in the interior 16 of the cam cover 10. The baffle 24 also includes lateral edges 54, 56 that extend between the first 42 and second 44 longitudinal edges of the baffle 24 in a direction transverse to axis a-a. The lateral edges 54, 56 of the baffle 24 do not abut the cam cover 10, but provide a clearance between the interior 16 of the cam cover 10 and the baffle 24.

Figure 4:
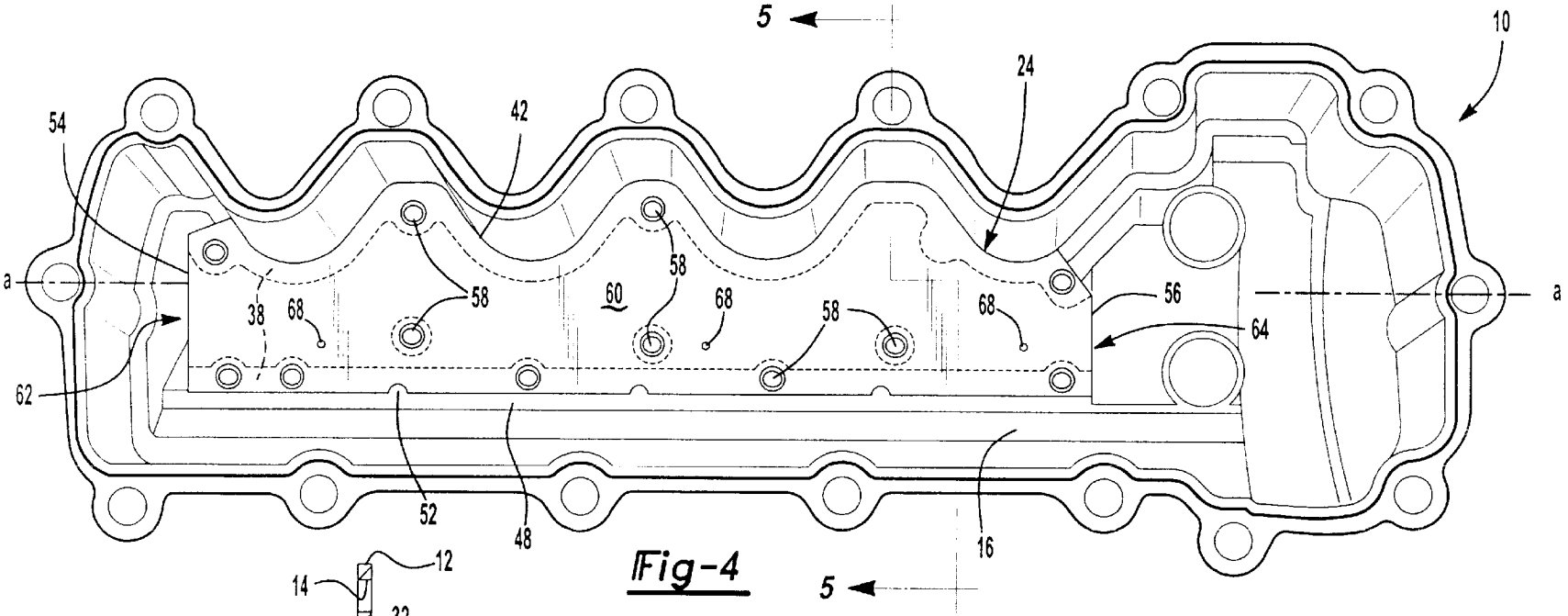
FIG. 4 is a plan view of the cam cover of FIG. 1, showing the baffle of FIG. 2 installed in the interior of the cam cover.
Figure 5:
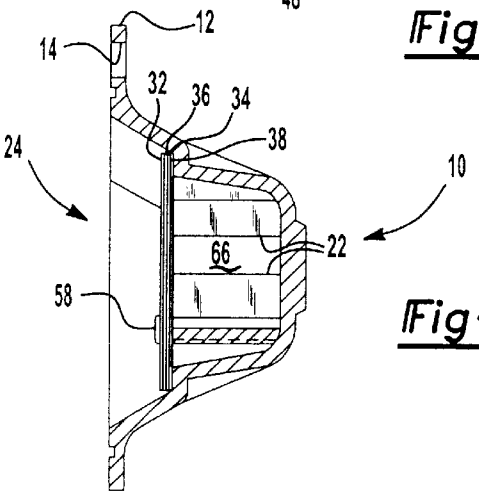
FIG. 5 is an end view of the cam cover and baffle, as viewed through section line 5—5 of FIG. 4.

This can be seen in FIG. 4 and FIG. 5, which show, respectively, a plan view of the baffle 24 installed in the interior 16 of the cam cover 10, and an end view of the cam cover 10 and baffle 24, viewed through section line 5—5 of FIG. 4. The baffle 24 is mounted on the cam cover 10 with the surface 40 of the base structural layer 34 and the isolation layer 38 facing the interior 16 of the cam cover 10. The ends 58 of the posts 28 have been heat staked against an outer surface 60 of the secondary structural layer 32 in order to secure the baffle 24 to the cam cover 10.

The clearances 62, 64 between the cam cover 10 and the lateral edges 54, 56 of the baffle 24 permit crankcase air to enter a channel 66, which is defined by the inward-facing surface 40 of the baffle 24 and the interior 16 of the cam cover 10. The crankcase air flows through the channel 66 and exits the cam cover 10 through the PVC aperture 18. The transverse ribs 22 create turbulence in the crankcase air as it flows through the channel 66. As a result of the turbulence, oil mist entrained in the crankcase airflow will tend to settle out of the gas stream, coalescing as droplets on the inward-facing surface 40 of the baffle 24, on the cam cover 10 ribs 22, etc. A series of oil drain holes 68 permit the oil droplets to escape from the channel 66.

EXAMPLE

A baffle was made by screen printing a foamed isolation layer on a steel plate. The components of the isolation layer included a silicone rubber, which was obtained from WACKER SILICONES of Adrian, Mich. under the designation ER93018. The silicone rubber included a major portion of polydimethylsiloxane, a minor portion (about one wt. % to about five wt. %) of trimethoxy[3-(oxiranylmethoxy)propyl]-silane, an organoplatinum curing catalyst, a cure inhibitor to improve pot life, and expandable microspheres (blowing agent). The silicone rubber was screen printed on the steel plate to a nominal thickness of 0.25 mm using a THIEME Model No. 1020 screen printer and a 60 mesh screen. The isolation layer was cured in a convection oven for ten minutes at about 149° C. The resulting foamed isolation layer had a thickness of about 0.44 mm and exhibited 55.7% compression under 100 psi stress.

It is to be understood that the above description and Example are intended to be illustrative and not limiting. Many embodiments will be apparent to those skilled in the art upon reading the above description. Therefore, the scope of the invention should be determined, not with reference to the above description, but with reference to the appended claims with the full scope of equivalents to which the claims are entitled.

What is claimed is:

1. A baffle adapted for use in an interior of a cam cover, the baffle comprising:

a base layer having a surface and being made of metal; and an isolation layer comprised of a resilient foam, the isolation layer disposed on the surface of the base layer in a pattern that leaves uncovered a portion of the surface of the base layer, the isolation layer providing an interface between the base layer and the cam cover when the baffle is installed in the interior of the cam cover.

2. The baffle of claim 1, wherein the base layer is made of steel.

3. The baffle of claim 1, further comprising a secondary layer bonded to the base layer, the secondary layer being made of metal.

4. The baffle of claim 3, wherein the secondary layer is made of steel.

5. The baffle of claim 3, further comprising a viscoelastic adhesive layer sandwiched between the base layer and the secondary layer.

6. The baffle of claim 5, wherein the viscoelastic adhesive layer comprises a UV curable polymer.

7. The baffle of claim 1, wherein the isolation layer is disposed on the surface of the base layer in a pattern that covers a portion of the surface of the base layer that would otherwise contact the cam cover if the isolation layer were absent.

8. The baffle of claim 1, wherein the isolation layer is disposed on the surface of the base layer in a pattern that leaves substantially uncovered a portion of the surface of the base layer that would not contact the cam cover if the isolation layer were absent.

9. The baffle of claim 1, wherein the resilient foam comprises a silicone rubber and a blowing agent.

10. The baffle of claim 1, wherein the resilient foam is comprised of precursors that are screen printable.

11. A baffle adapted for use in an interior of a cam cover, the baffle comprising:

first and second structural layers, and a viscoelastic adhesive layer interposed between the first and second structural layers; and an isolation layer comprised of a resilient foam, the isolation layer disposed on a surface of the first structural layer in a pattern that leaves uncovered a portion of the surface of the first structural layer, the isolation layer providing an interface between the first structural layer and the cam cover when the baffle is installed in the interior of the cam cover.

12. The baffle of claim 11, wherein the first and second structural layers are made of metal.

13. The baffle of claim 12, wherein the first and second structural layers are made of steel.

14. The baffle of claim 11, wherein the viscoelastic adhesive layer comprises a UV curable polymer.

15. The baffle of claim 11, wherein the isolation layer is disposed on the surface of the first structural layer in a pattern that covers a portion of the surface of the first structural layer that would otherwise contact the cam cover if the isolation layer were absent.

16. The baffle of claim 11, wherein the isolation layer is disposed on the surface of the first structural layer in a pattern that leaves substantially uncovered a portion of the surface of the first structural layer that would not contact the cam cover if the isolation layer were absent.

17. The baffle of claim 11, wherein the resilient foam comprises a silicone rubber and a blowing agent.

18. The baffle of claim 11, wherein the resilient foam is comprised of precursors that are screen printable.

* * * * *